US005699090A

United States Patent [19]

Wade et al.

[11] Patent Number: 5,699,090

[45] Date of Patent: Dec. 16, 1997

[54] OUT OF INK DETECTOR FOR A THERMAL INKJET PRINTER

[75] Inventors: John M. Wade; Dean C. Bayerle, both of Poway, Calif.

[73] Assignee: Hewlett-Packard Company, Palo Alto, Calif.

[21] Appl. No.: 332,326

[22] Filed: Oct. 31, 1994

Related U.S. Application Data

[63] Continuation-in-part of Ser. No. 145,904, Oct. 29, 1993, Pat. No. 5,428,376.

[51] Int. Cl.[6] ..... B41J 2/195; B41J 29/393

[52] U.S. Cl. ..... 347/7; 347/19; 347/60

[58] Field of Search ..... 347/7, 9, 11, 14, 347/17, 19, 60

[56] References Cited

U.S. PATENT DOCUMENTS 5,206,668 4/1993 Lo et al. ..... 347/6

FOREIGN PATENT DOCUMENTS 2 169 856 7/1986 United Kingdom ..... 347/60

*Primary Examiner*—Mark J. Reinhart
*Assistant Examiner*—Craig A. Hallacher
*Attorney, Agent, or Firm*—Dennis G. Stenstrom

[57] ABSTRACT

When a thermal inkjet print cartridge operates to eject ink, three things happen at once: (1) heating by the heating resistor with flow of heat into the ink chamber; (2) cooling by heat drain toward the reservoir, print cartridge body and to ambient; and (3) cooling by carrying away of heat in the ink drops and replacement by cooler ink from the reservoir. The present invention is a method of detecting a depleted ink supply by monitoring the temperature of the printhead substrate with a temperature sensitive resistive trace on the printhead surface. When the print cartridge is warmed with warming pulses to a temperature higher than its normal operating temperature: and then firing pulses are implemented to eject ink, the temperature measured by the thermal sense resistor will decrease if the print cartridge is ejecting its normal, or nearly normal, amount of ink. If the print cartridge is ejecting less than its normal amount of ink the temperature will decrease less, stay the same, or even increase. It is this temperature increase or decrease that is used as an ink ejection detector. The method is quickly and readily performed by a printer before printing or between printing intervals. The indication of a depleted ink supply can be used to develop printer shutdown, or use of a reserve print cartridge, or an operator warning, or a combination of these tactics.

20 Claims, 3 Drawing Sheets

OUT OF INK DETECTOR FOR A THERMAL INKJET PRINTER

CROSS-REFERENCE TO RELATED APPLICATIONS

This application is a continuation-in-part application of U.S. application Ser. No. 08/145,904, filed Oct. 29, 1993 U.S. Pat. No. 5,428,376, entitled "THERMAL TURN-ON ENERGY TEST FOR AN INK JET PRINTER," by John M. Wade, et al. This application also relates to the subject matter disclosed in co-pending U.S. applications Ser. No. 08/156,172, filed Nov. 22, 1993 entitled "INKDROP-VOLUME TEST USING HEAT-FLOW EFFECTS, FOR THERMAL-INKJET PRINTERS," by John M. Wade; U.S. application Ser. No. 08/056,698, filed Apr. 30, 1993, entitled "METHOD FOR DETECTING AND CORRECTING AN INTRUSION OF AIR INTO A PRINTHEAD SUBSTRATE OF AN INK JET CARTRIDGE" by Jaime A. Bohorquez, et al.; and U.S. patent application filed concurrently herewith, entitled "INK LEVEL SENSOR FOR AN INKJET PRINT CARTRIDGE," by John M. Wade, et al., U.S. application Ser. No. 08/332,544. The above co-pending applications are assigned to the present assignee and are incorporated herein by reference.

FIELD OF THE INVENTION

The present invention generally relates to inkjet and other types of printers and, more particularly, to the ink supply to a print cartridge of an inkjet printer.

BACKGROUND OF THE INVENTION

An ink jet printer forms a printed image by printing a pattern of individual dots at particular locations of an array defined for the printing medium. The locations are conveniently visualized as being small dots in a rectilinear array. The locations are sometimes called "dot locations", "dot positions", or "pixels". Thus, the printing operation can be viewed as the filling of a pattern of dot locations with dots of ink.

Ink jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The printheads of thermal ink jet printers are commonly implemented as replaceable printhead cartridges which typically include one or more ink reservoirs and an integrated circuit printhead that includes a nozzle plate having an array of ink ejecting nozzles, a plurality of ink firing chambers adjacent respective nozzles, and a plurality of heater resistors adjacent the firing chambers opposite the ink ejecting nozzles and spaced therefrom by the firing chambers.

To print a single dot of ink, an electrical current from an external power supply is passed through a selected thin film resistor. The resistor is then heated, in turn superheating a thin layer of the adjacent ink within a vaporization chamber, causing explosive vaporization, and, consequently, causing a droplet of ink to be ejected through an associated nozzle onto the paper.

An important consideration in thermal-inkjet printer operation is exhaustion of the ink supply in each pen reservoir. Some printers have drop sensors for determining photoelectrically when a pen (or individual jet module) is not firing, so that the printer can be shut down and an alarm or indicator actuated to alert the operator to replace the pen and thereby avoid wasting time and paper. Such a system is useful, but generally provides only an indication that ink is already exhausted. A preferable system would alert the operator that ink is about to run out.

Existing inkjet printers are unable to detect depletion of their ink supply and consequently, they sometimes attempt to print with a depleted ink supply. It would be advantageous to have a device that automatically detects and corrects for a depleted ink supply. This device would prevent the printhead substrate from printing when empty and would prevent the temperature of the printhead substrate from reaching dangerously high levels which can damage the firing resistors in thermal inkjet printers.

The ability to detect and correct for a depleted ink supply is also an important requirement for print cartridges installed in facsimile machines, because the data is lost if not printed out correctly. If the receiver does not have a printed record of who made the transmission, this data is irretrievably lost. The ability to detect and correct for a depleted ink supply is also an especially important feature of printers that create large color plots that require a large investment of ink and print time that would be lost if the ink supply becomes depleted during creation of the plot. Large volume printers, where the user is often absent, must be able to detect and correct for a depleted ink supply to prevent them from attempting to print with an empty print cartridge for an extended time. The corrective action may be to stop printing, alert the user to the impending exhaustion of ink supply and move the inkjet cartridge to a position where the inkjet cartridge can be replaced.

Accordingly, the prevailing technology in this field has not heretofore provided an entirely satisfactory way to provide advance warning that an inkjet print cartridge is about to run out of ink. It would therefore be an advantage to provide a thermal ink jet printer that warns that an inkjet print cartridge has run out of ink.

SUMMARY OF THE INVENTION

When a thermal inkjet print cartridge operates to eject ink, three things happen at once: (1) heating by the heating resistor with flow of heat into the ink chamber; (2) cooling by heat drain toward the reservoir, print cartridge body and to ambient; and (3) cooling by carrying away of heat in the ink drops and replacement by cooler ink from the reservoir.

The present invention is a method of detecting a depleted ink supply by monitoring the temperature of the printhead substrate with a temperature sensitive resistive trace on the printhead surface. When the print cartridge is warmed with warming pulses to a temperature higher than its normal operating temperature: and then firing pulses are implemented to eject ink, the temperature measured by the thermal sense resistor will decrease if the print cartridge is ejecting its normal, or nearly normal, amount of ink. If the print cartridge is ejecting less than its normal amount of ink the temperature will decrease less, stay the same, or even increase. It is this temperature increase or decrease that is used as an ink ejection detector.

The foregoing and other advantages are provided by the invention in a method that includes the steps of (a) applying to the printhead non-ink firing warming pulses to warm the printhead to a temperature that is higher than a temperature that would be produced pursuant to ink firing pulses; (b)

applying to the printhead ink firing pulses; (c) sampling the temperature of the printhead while the ink firing pulses are applied to the ink firing resistors to produce a set of temperature samples; (d) determining a temperature approximation equation for a curve that is fitted to the temperature samples, wherein the approximation equation defines temperature as a function of time, the temperature approximation equation having a slope associated therewith; and (e) ascertaining whether an out of ink condition exists from the slope of the temperature approximation equation.

The method is quickly and readily performed by a printer before printing or between printing intervals. The indication of a depleted ink supply can be used to develop printer shutdown, or use of a reserve print cartridge, or an operator warning, or a combination of these tactics.

DETAILED DESCRIPTION OF THE DISCLOSURE

Figure 1:
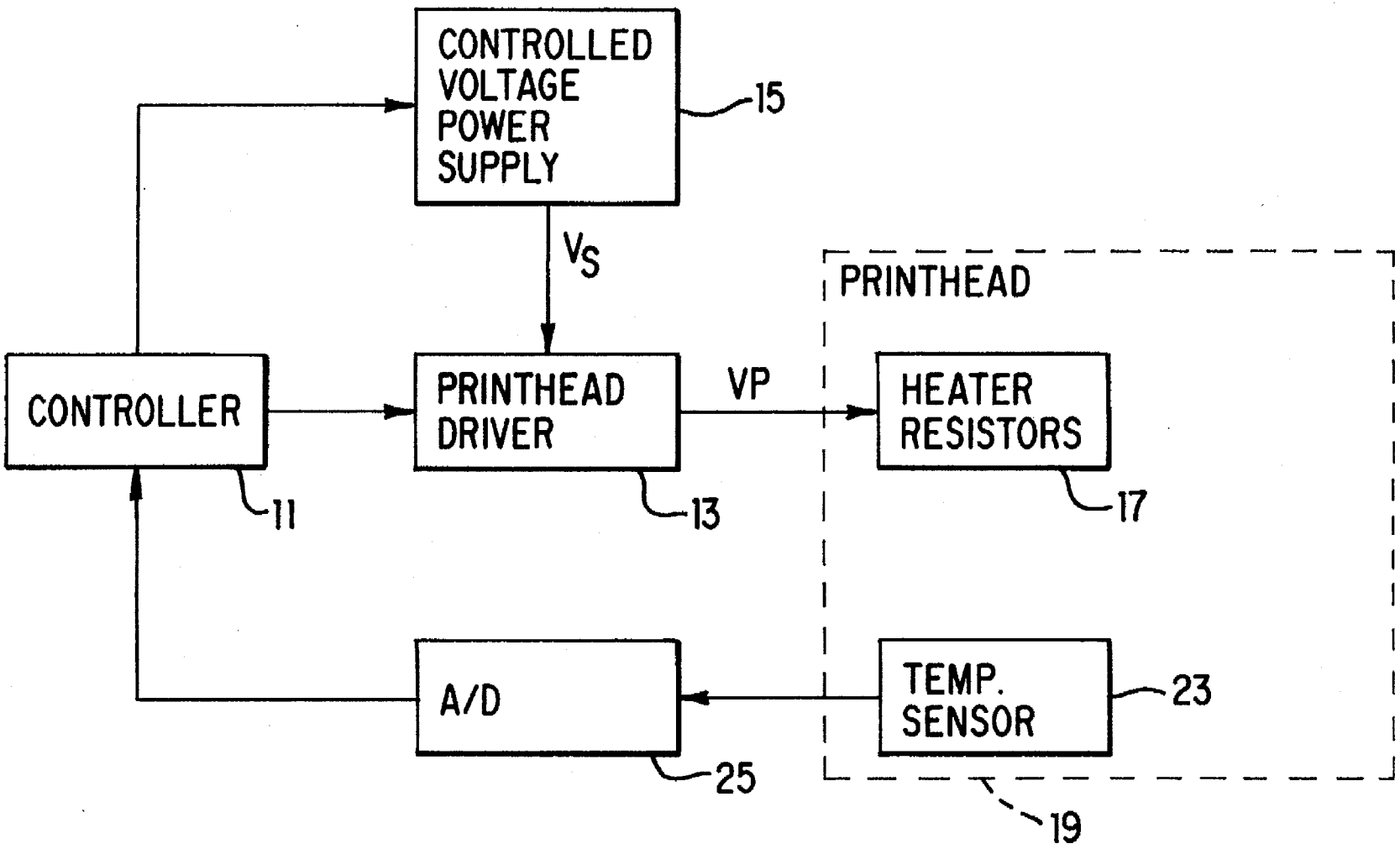
FIG. 1 is a schematic block diagram of the thermal ink jet components for implementing the invention.

Referring now to FIG. 1, shown therein is a simplified block diagram of a thermal ink jet printer that employs the techniques of the invention. A controller 11 receives print data input and processes the print data to provide print control information to a printhead driver circuit 13. A controlled voltage power supply 15 provides to the printhead driver circuit 13 a controlled supply voltage $V_s$ whose magnitude is controlled by the controller 11. The printhead driver circuit 13, as controlled by the controller 11, applies driving or energizing voltage pulses of voltage VP to a thin film integrated circuit thermal ink jet printhead 19 that includes thin film ink drop firing heater resistors 17.

The controller 11, which can comprise a microprocessor architecture in accordance with known controller structures, more particularly provides pulse width and pulse frequency parameters to the printhead driver circuitry 13 which produces drive voltage pulses of the width and frequency as selected by the controller, and with a voltage VP that depends on the supply voltage $V_s$ provided by the voltage controlled power supply 15 as controlled by the controller 11. Essentially, the controller 11 controls the pulse width, frequency, and voltage of the voltage pulses applied by the driver circuit to the heater resistors. As with known controller structures, the controller 11 would typically provide other functions such as control of the movement of the printhead carriage (not shown) and control of movement of the print media.

The integrated circuit printhead of the thermal ink jet printer of FIG. 1 also includes a thermal sense resistor or temperature sensor 23 located in the proximity of some of the heater resistors, and provides an analog electrical signal representative of the temperature of the integrated circuit printhead. The analog output of the temperature sensor 21 is provided to an analog-to-digital (A/D) converter 25 which provides a digital output to the controller 11. The digital output of the A/D converter 25 comprises quantized samples of the analog output of the temperature sensor 23. The output of the A/D converter 25 is indicative of the temperature detected by the temperature sensor.

Figure 2:
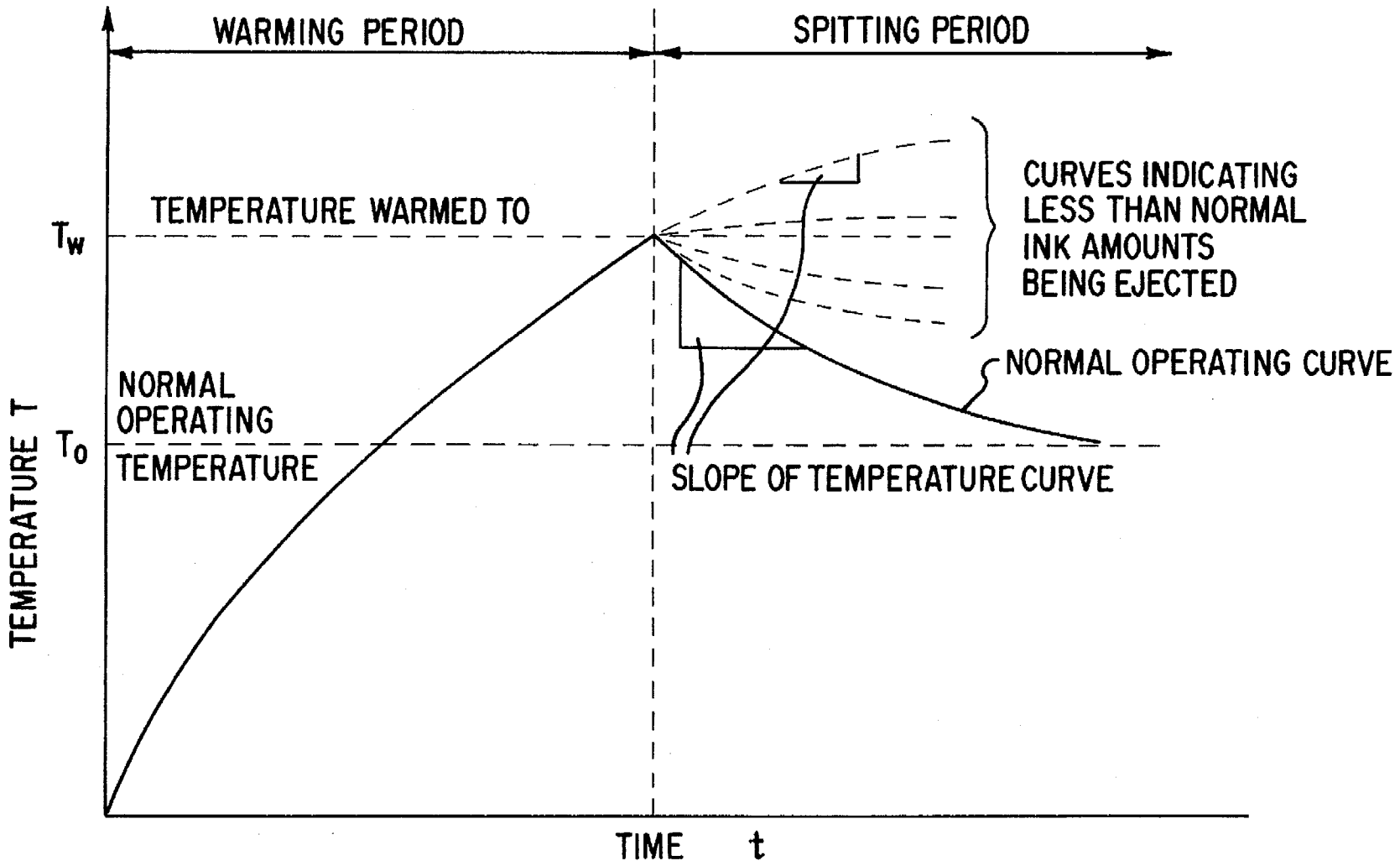
FIG. 2 is a graph showing printhead temperature plotted against time during the procedure for determining ink exhaustion in accordance with the present invention.
Figure 3:
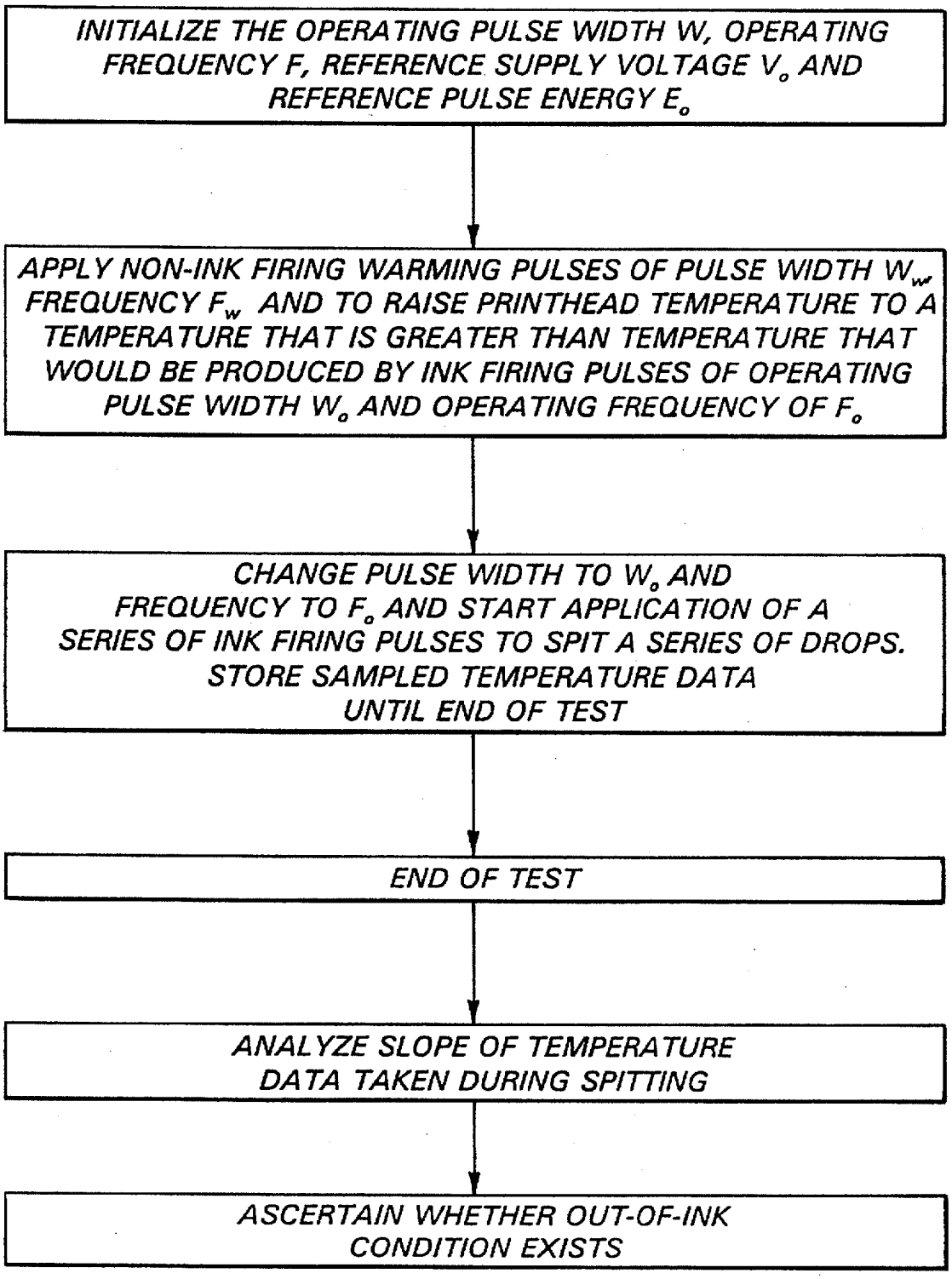
FIG. 3 sets forth a flow diagram of a procedure for determining ink exhaustion in accordance with the present invention.

FIG. 2 sets forth a representative graph of normalized printhead temperature plotted against time. The graph of FIG. 2 indicates two different phases of operation of the heater resistors of a printhead. The first phase is a non-nucleating phase wherein the energy is insufficient to cause nucleation. In the non-nucleating phase printhead temperature increases with time while no ink is ejected. The next phase is the spitting phase wherein the pulse energy is sufficient to cause ink drop forming nucleation. Normally the printhead temperature decreases with increasing pulse energy in this phase. The decrease in printhead temperature is due to transfer of heat from the printhead by the ink drops.

In accordance with the invention, a printhead is tested for out of ink generally as follows. The printhead is warmed to a temperature that is higher than would normally be achieved during printing, for example greater than the temperature that would be achieved by ink firing pulses having a predetermined reference pulse energy (described more particularly herein) and a pulse frequency that is higher than the intended operating frequency. For example, non-ink firing warming pulses can be applied to warm the printhead, wherein the warming pulses have an average power that is substantially equal to the average power of ink firing pulses having the predetermined reference pulse energy and a pulse frequency equal to the operating frequency. A continuous series of ink firing pulses at the predetermined pulse frequency is then applied to the printhead. The pulse energy of the ink firing pulses is at the reference pulse energy. The output of the temperature sensor is sampled during the spitting portion of the test. For a properly operating printhead and temperature sensor, temperature data acquisition continues for a predetermined time. In accordance with the invention, acceptable temperature data is analyzed by determining the slope of a curve fitted to the temperature samples.

The reference pulse energy referred to previously in conjunction with the pulse energy at the start of the application of ink firing pulses is a nominal operating pulse energy that has been determined for the particular printhead design to be sufficient to insure that ink drops of the proper volume would be produced by all examples of that printhead design pursuant to voltage pulses having a pulse energy equal to the reference pulse energy. For example, the reference pulse energy can comprise a nominal operating energy that would be provided to the printhead if the disclosed turn on energy measurement is not performed, or if the test of the printhead produces unacceptable temperature.

As previously described, the non-ink firing warming pulses to the printhead to raise its temperature have an average power that is substantially equal to the average power of ink firing pulses having a pulse energy equal to the reference pulse energy $E_o$, and such warming pulses can conveniently have a voltage that is equal to the reference pulse voltage $VP_o$. The average power of the pulses provided to the heater resistors can be represented by the product of the pulse frequency and the pulse width, and therefore the equality between the average power of the warming pulses and the average power of the ink firing pulses having a pulse energy equal to the reference $E_o$ can be expressed as follows:

$$W_w*F_w=W*F$$

The pulse width $W_w$ of the warming pulses is selected to be sufficiently smaller than the fixed operating pulse width W so that drops are not formed pursuant to the warming pulse width $W_w$, and the appropriate warming pulse frequency $F_w$ is determined by solving Equation 5 for the warming pulse frequency $F_w$:

$$F_w = W*F/W_w$$

As discussed above, the integrated circuit printhead of the thermal ink jet printer of FIG. 1 also includes a thermal sense resistor or temperature sensor 23 located in the proximity of some of the heater resistors, and provides an analog electrical signal representative of the temperature of the integrated circuit printhead. The analog output of the temperature sensor 21 is provided to an analog-to-digital (A/D) converter 25 which provides a digital output to the controller 11. The digital output of the A/D converter 25 comprises quantized samples of the analog output of the temperature sensor 23. The output of the A/D converter 25 is indicative of the temperature detected by the temperature sensor.

The thermal sense resistor 23 is a temperature sensor whose resistance increases with increasing temperature. In the present embodiment, it is deposited on the printhead substrate as a thin film resistor along with the heater resistors 17. The substrate, which in the preferred embodiment is silicon, has a high thermal conductivity and heats as the heater resistors 17 are fired to eject ink drops through the nozzles of the printhead 19. The substrate, in turn, heats the thermal sense resistor 23, thereby increasing its resistance.

When a thermal inkjet printhead operates to eject ink, three things happen at once: (1) heating by the heating resistor with flow of heat into the ink chamber; (2) cooling by heat drain toward the reservoir, print cartridge body and to ambient; and (3) cooling by carrying away of heat in the ink drops and replacement by cooler ink from the reservoir. Thus, the rate of temperature rise of the substrate toward an equilibrium value depends, among other things, upon the volume of ink being ejected from the nozzles during printing. The reason for this phenomenon is that the liquid ink leaving the printhead removes heat from the printhead. As the amount of liquid ink being ejected, decreases, the amount of heat energy being removed decreases. The heat formerly removed by the ink flow is instead absorbed by the printhead substrate, which causes the substrate's temperature to rise at a faster rate than it would if ink were being ejected. Thus, if little or no ink is ejected, the temperature of the substrate rises. Accordingly, monitoring the substrate temperature as the printhead is being fired can indicate whether ink is being ejected.

Referring now to FIG. 4, set forth therein is a flow diagram of a procedure in accordance with the invention for determining whether ink is being ejected by the printhead in accordance with the present invention. At 110 various variables are initialized. In particular, the operating pulse width W, operating frequency F, reference supply voltage $V_o$, and reference pulse energy $E_o$, as described above and in co-pending U.S. application Ser. No. 08/145,904, filed Oct. 29, 1993, entitled "Thermal Turn-on Energy Test for an Inkjet Printer."

At 120 warming pulses of width $W_w$ and frequency $F_w$ are applied to the printhead to raise the temperature of the printhead to a temperature that is higher than the temperature that would be produced by ink firing pulses of the operating width W and the operating frequency F. For example, the warming supply voltage can be equal to the reference supply voltage $V_o$, and the pulse width $W_w$ and the pulse frequency $F_w$ of the warming pulses can be determined as described previously. Alternatively, the warming supply voltage $V_w$ can be greater than the reference supply voltage $V_o$ while maintaining the pulse width $W_w$ and the pulse frequency $F_w$ at the values calculated for a supply voltage of $V_o$. By way of illustrative example, the warming pulses can be applied for a predetermined amount of time that is known to sufficiently raise the temperature of the printhead, or the output of the temperature sensor can be monitored to apply the warming pulses until a predetermined temperature is reached.

At 130 the pulse width is changed $W_o$ and the frequency to $F_o$ and the application of a continuous series ink spitting or firing pulses is started. During this time, temperature data obtained from the thermal sense resistor is sampled and stored. At 140 after acceptable temperature data is acquired the test is ended. At 150 an approximation curve is fitted to the sampled temperature data to obtain temperature as a function of time and the slope is determined. At 160 based on the slope of the temperature data it is ascertained whether an out of ink condition exists.

The method is quickly and readily performed by a printer before printing or between printing intervals. The indication of a depleted ink supply can be used to develop printer shutdown, or use of a reserve print cartridge, or an operator warning, or a combination of these tactics. The corrective action may be to stop printing, alert the user to the imminent out of ink condition and moving the inkjet cartridge to a position where the inkjet cartridge can be replaced. The alert provided to the user may be by a light or audible signal from the printer, or by a message on the screen or audible sound from the computer controlling the print operations, or both. In a printer that has at least two print cartridges the corrective action may also include the option of putting into service another print cartridge. This arrangement is particularly beneficial in printing equipment that is used on an unattended basis, as for example a facsimile machine, since such devices are generally operated overnight and on weekends, when no operator is available to change print cartridges.

The method is a very reliable out of ink detector, but since some amount of ink is used to perform it, it is desirable to use other less reliable methods to indicate when the need for performing the test becomes necessary. One such preferred less reliable method is to count the drops ejected from a cartridge and using an average expected drop volume calculate the total volume of ink expelled. Since the initial volume of ink is known, it can be determined when the print cartridge is nearing empty and then begin performing the method of the present invention.

Although the foregoing has been a description and illustration of specific embodiments of the invention, various modifications and changes thereto can be made by persons skilled in the art without departing from the scope and spirit of the invention as defined by the following claims.

What is claimed is:

1. A method for operating a thermal-ink jet printer including a printhead having ink-firing heater resistors responsive to pulses provided to the printhead, said method including detection of an out-of-ink condition in the printer and comprising the steps of:

directing to the printhead ink-nonfiring warming pulses to warm the printhead to a temperature that is higher than a temperature that would be produced pursuant to ink-firing pulses;

then directing to the printhead ink-firing pulses;

sampling the temperature of the printhead while the ink-firing pulses are directed to the ink-firing resistors to produce a set of temperature samples;

determining a temperature approximation equation for a curve that is fitted to the temperature samples, wherein the approximation equation defines temperature as a function of time, the temperature approximation having a slope associated therewith;

determining the slope of the determined temperature approximation equation;

ascertaining from the determined slope of the temperature approximation equation whether an out-of-ink condition exists; and holding, in a nonvolatile memory, automatically readable instructions for automatic performance of the above-enumerated steps.

2. The method of claim 1, further comprising the step of:

applying the ascertained out-of-ink condition to control subsequent operation of the printer.

3. The method of claim 2, wherein:

said applying step comprises automatically bringing into service a different printhead.

4. The method of claim 1, wherein:

the ascertaining step comprises comparing the determined slope with a known downward slope for a printhead that is ejecting a normal amount of ink.

5. The method of claim 1, wherein:

the equation-determining step comprises determining exclusively one single equation for one single curve that is fitted to all the temperature samples;

the slope-determining step comprises determining exclusively one single slope for said temperature approximation equation.

6. The method of claim 1, further comprising the step of:

before the directing steps and starting upon installation of a printhead, counting all drops ejected from a printhead; and comparing the count of ejected drops with an expected total number of drops before the printhead should approach an out-of-ink condition, to determine when to begin said directing steps and subsequent steps.

7. The method of claim 1, wherein:

said directing steps both comprise directing to the printhead pulses at a reference pulse energy.

8. The method of claim 7, wherein:

the reference pulse energy is a nominal operating pulse energy that has been determined for the particular printhead to be sufficient to ensure that inkdrops of a proper volume are produced by all normal units of that printhead.

9. The method of claim 8, wherein:

the ink-nonfiring pulses are at a warming pulse width $W_w$ which is sufficiently smaller than a fixed operating pulse width W that drops are not formed in response to the ink-nonfiring pulses;

the ink-nonfiring pulses are at a frequency $F_w$ higher than the intended operating frequency F and determined by:

$$F_W = F \cdot W / W_F;$$

and the ink-nonfiring pulses are at a voltage substantially equal to the intended operating voltage.

10. The method of claim 1, wherein:

the ink-nonfiring pulses are at a warming pulse width $W_W$ which is sufficiently smaller than a fixed operating pulse width W that drops are not formed in response to the ink-nonfiring pulses;

the ink-nonfiring pulses are at a frequency $F_w$ higher than the intended operating frequency F and determined by:

$$F_W = F \cdot W / W_F;$$

and the ink-nonfiring pulses are at a voltage substantially equal to the intended operating voltage.

11. The method of claim 1, wherein:

the ascertaining step comprises comparing the determined slope with a known downward slope for a printhead that is ejecting a normal amount of ink.

12. A method for operating a thermal-inkjet facsimile machine, said machine being for unattended operation overnight and on weekends, and said machine including a printhead having ink-firing heater resistors responsive to pulses provided to the printhead; said method including detection of an out-of-ink condition in the facsimile machine, and comprising these steps:

while the facsimile machine is operating unattended overnight and on weekends, directing to the printhead ink-nonfiring warming pulses to warm the printhead to a temperature that is higher than a temperature that would be produced pursuant to ink-firing pulses;

then, while the facsimile machine continues operating overnight and on weekends, directing to the printhead ink-firing pulses;

sampling the temperature of the printhead while the ink-firing pulses are directed to the ink-firing resistors to produce a set of temperature samples;

then, while the facsimile machine continues operating overnight and on weekends, determining a temperature approximation equation for a curve that is fitted to the temperature samples, wherein the approximation equation defines temperature as a function of time, the temperature approximation having a slope associated therewith;

then, while the facsimile machine continues operating overnight and on weekends, determining the slope of the temperature approximation equation;

then, while the facsimile machine continues operating overnight and on weekends, ascertaining from the determined slope of the temperature approximation equation whether an out-of-ink condition exists; and then, while the machine continues operating overnight and on weekends, applying the ascertained out-of-ink condition to automatically bring into service a different printhead.

13. The method of claim 12, wherein:

the ascertaining step comprises comparing the determined slope with a known downward slope for a printhead that is ejecting a normal amount of ink.

14. The method of claim 12, wherein:

the equation-determining step comprises determining exclusively one single equation for one single curve that is fitted to all the temperature samples;

the slope-determining step comprises determining exclusively one single slope for said temperature approximation equation.

15. The method of claim 12, further comprising the step of:

before the directing steps and starting upon installation of a printhead, counting all drops ejected from a printhead; and comparing the count of ejected drops with an expected total number of drops before the printhead should approach an out-of-ink condition, to determine when to begin said directing steps and subsequent steps.

16. The method of claim 12, wherein:

the ink-nonfiring pulses are at a warming pulse width $W_w$ which is sufficiently smaller than a fixed operating pulse width W that drops are not formed in response to the ink-nonfiring pulses;

the ink-nonfiring pulses are at a frequency $F_W$ higher than the intended operating frequency F and determined by:

$$F_W = F \cdot W / W_F;$$

and the ink-nonfiring pulses are at a voltage substantially equal to the intended operating voltage.

17. A thermal-inkjet printer comprising:

a printhead having ink-firing heater resistors responsive to pulses provided to the printhead;

first means for directing to the printhead ink-nonfiring warming pulses to warm the printhead to a temperature that is higher than a temperature that would be produced pursuant to ink-firing pulses;

second means for then directing to the printhead ink-firing pulses;

means for sampling the temperature of the printhead while the second directing means are directing ink-firing pulses to the ink-firing resistors, to produce a set of temperature samples;

means for determining a temperature approximation equation for a curve that is fitted to the temperature samples, wherein the approximation equation defines temperature as a function of time, the temperature approximation having a slope associated therewith;

means for determining the slope of the determined temperature approximation equation; and means for ascertaining from the determined slope of the temperature approximation equation whether an out-of-ink condition exists.

18. The printer of claim 17, further comprising:

means for applying the ascertained out-of-ink condition to control subsequent operation of the printer.

19. The method of claim 17, wherein:

the ascertaining means comprise means for comparing the determined slope with a known downward slope for a printhead that is ejecting a normal amount of ink.

20. The method of claim 17, wherein:

the equation-determining means comprise means for determining exclusively one single equation for one single curve that is fitted to all the temperature samples; and the slope-determining means comprise means for determining exclusively one single slope for said temperature approximation equation.

* * * * *